US007568262B2

(12) United States Patent
Schwarz et al.

(10) Patent No.: US 7,568,262 B2
(45) Date of Patent: Aug. 4, 2009

(54) DEVICE AND METHOD FOR DEPOSITING A FILAMENTARY STRAND

(75) Inventors: Olaf Schwarz, Neumünster (DE); Bernhard Schoennagel, Neumünster (DE); Matthias Strebe, Neumünster (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 12/131,529

(22) Filed: Jun. 2, 2008

(65) Prior Publication Data

US 2008/0295292 A1 Dec. 4, 2008

Related U.S. Application Data

(63) Continuation of application No. PCT/EP2006/011638, filed on Dec. 5, 2006.

(30) Foreign Application Priority Data

Dec. 6, 2005 (DE) ..... 10 2005 058 061

(51) Int. Cl.
*D01G 25/00* (2006.01)

(52) U.S. Cl. ..... 19/159 R; 19/159 A

(58) Field of Classification Search ..... 19/159 A, 19/159 R, 160
See application file for complete search history.

(56) References Cited

U.S. PATENT DOCUMENTS

| | | | | |
|---|---|---|---|---|
| 3,378,898 | A | 4/1968 | Mendes | |
| 4,248,592 | A * | 2/1981 | Salvans et al. | 8/485 |
| 4,327,855 | A * | 5/1982 | Lee et al. | 226/97.4 |
| 5,913,797 | A * | 6/1999 | Saleh | 53/429 |
| 6,199,411 | B1 * | 3/2001 | Schenck et al. | 68/22 R |
| 7,107,740 | B2 | 9/2006 | Schoennagel et al. | |
| 2004/0031239 | A1 * | 2/2004 | Schoennagel et al. | 53/429 |
| 2007/0017182 | A1 * | 1/2007 | Schoennagel et al. | 53/116 |

(Continued)

FOREIGN PATENT DOCUMENTS

DE 198 35 711 A1 12/1999

(Continued)

OTHER PUBLICATIONS

International Preliminary Report on Patentability for International Application No. PCT/EP2006/011638, mailed Nov. 6, 2008.

*Primary Examiner*—Shaun R Hurley
(74) *Attorney, Agent, or Firm*—Alston & Bird LLP

(57) ABSTRACT

A device and a method for serially depositing a filamentary strand into several cans of a can creel with a traversable depositing device. The depositing device comprises a conveyance means which is held in such a manner that it can be moved and which can be guided into several depositing positions. The strand is fed continuously to the conveyance means and from each depositing position at least one of the cans of the can creel can be filled by the conveyance means. In order to make the filling of a plurality of cans in the can creel as rapid and flexible as possible, the depositing device comprises a robot with a multi-axis robot arm, where the robot carries the conveyance means at the free end of its robot arm. Thus, the conveyance means can be guided, in its positioning as well as in its movements for filling the can, by the multi-axis robot arm of the robot.

16 Claims, 7 Drawing Sheets

U.S. PATENT DOCUMENTS

2007/0199281 A1 * 8/2007 Schoennagel et al. ..... 53/428

FOREIGN PATENT DOCUMENTS

DE 102 32 745 A1 2/2004
JP 55-52863 A 4/1980
JP 61-37669 A 2/1986
WO WO 2005/078172 A1 8/2005
WO WO 2006/029768 A1 3/2006

* cited by examiner

DEVICE AND METHOD FOR DEPOSITING A FILAMENTARY STRAND

CROSS REFERENCE TO RELATED APPLICATION

The present application is a continuation of international application PCT/EP2006/011638, filed Dec. 5, 2006, and which designates the U.S. The disclosure of the referenced application is incorporated herein by reference.

BACKGROUND OF THE INVENTION

The present invention relates to an apparatus and method for depositing a filamentary strand into several cans, of the general type disclosed in WO 2005/078172 A1.

In the known device and the known method, a filamentary strand drawn off from a spinning device is conveyed by means of a traversable depositing device directly into the cans of a can creel. For this, the depositing device comprises a movable conveyance means which is positioned by the depositing device in alternation above the respective can to be filled. During the conveyance of the filamentary strand the conveyance means is moved in several directions of motion in an oscillating manner to fill the can so that there is a uniform filling of the can.

The known device and the known method have in particular the advantage that the can to be filled is held in a fixed position in the can creel during the depositing of the filamentary strand so that when dividing or combining several can creels one part of the cans is prepared for emptying and another part of the can creel is prepared for filling. With this, in particular in the production of staple fibers, a high integration between the spinning device and a fiber line can be produced. In order to be able to carry out in a flexible manner the process steps running independently of one another for the melt-spinning of the filamentary strand and for the further treatment of the filamentary strand, e.g. to form staple fibers, the filling of the cans and the emptying of the cans are to be coordinated with one another. For this, as rapid and flexible a filling of the cans as possible is desirable.

Accordingly, it is an object of the invention to improve the known device as well as the known method in such a manner that a plurality of cans within one can creel can be filled with a filamentary strand as rapidly and flexibly as possible.

An additional object of the invention lies in a device and a method for depositing a filamentary strand into cans of a can creel being provided in which the filling as well the emptying of the cans in the creel can be done without having an effect on one another.

SUMMARY OF THE INVENTION

The above and other objects and advantages of the present invention are achieved by the provision of a strand depositing device which includes a guide carriage mounted for movement along a can creel to any one of the several depositing positions, a conveyance means for positively advancing a filamentary strand into a can, and a robot having a multi-axis robot arm interconnecting the conveyance means to the guide carriage. Thus at least one can of the can creel is able to be filled by the conveyance means at each depositing position.

The invention has the particular advantage that the conveyance means can be guided with great flexibility and a high degree of freedom in positioning immediately before the filling as well as in movement during the filling. Thus, the cans could be held in any arrangement within the can creel without in so doing taking into account the traverse paths of the depositing device. Within each depositing position the additional guiding of the conveyance means is, according to the invention, controlled by a robot which carries the conveyance means at the free end of a multi-axis robot arm. The movements of the conveyance means for conveying and depositing the filamentary strand into the cans can be executed with a maximum degree of freedom. Along with this, the movement processes controlled by the robot are distinguished in particular by their reproducibility so that the filling and the degree of filling of the cans in the can creel are essentially the same.

According to an advantageous extension of the device according to the invention the robot and its robot arm are designed in such a manner that from one of the depositing positions of the robot the conveyance means held at the free end of the robot arm can be guided into several filling positions which can be approached one after another for filling several cans. With this, the positioning of the robot can be restricted to a few positions in order to fill as great a number of cans within the can creel as possible.

For this, the robot arm is formed with at least five axes of motion through which the positioning and the movement of the conveyance means in one of the filling positions for filling the associated cans can be executed and controlled. With this, on the one hand, the movement processes required for the filling and, on the other hand, the positioning of the conveyance means into the respective filling positions can be executed with great flexibility.

For the positioning of the robot into the individual depositing positions, the depositing device comprises according to an advantageous embodiment of the invention a guide carriage which supports the robot and which is guided in at least one guideway above the can reel. The guide carriage can preferably be guided therein by linear movements between the individual depositing positions.

In order to be able to carry out simultaneously a filling of the cans and an emptying of the cans in a stationary can creel, the robot is preferably held suspended on the guide carriage. In this way the strand guides required for the emptying of the cans can be freely disposed in a plane above the can creel without an obstruction of the depositing device arising.

For filling a plurality of cans disposed next to one another in a row in a can creel, the embodiment of the invention has proven itself particularly advantageous in which the guideway for the guide carriage extends parallel to a longitudinal side of the can creel, where to one side of the guideway at least one row of cans disposed next to one another is held in the can creel.

Preferably the guideway of the guide carriage is disposed in a plane of symmetry of the can creel so that at each of the sides of the guideway one or more rows of cans disposed next to one another are held in the can creel.

In order to obtain a uniform, fault-free feeding of the filamentary strand during the filling process of a can, it is provided according to a particular embodiment of the invention that the movements of the conveyance means for depositing the filamentary strand are controlled by the robot arm in such a manner that the conveyance means executes an oscillating pivoting movement and an oscillating deflecting movement about a common virtual pivot axis. In so doing, the pivoting movement and the deflecting movement are preferably aligned so as to be generally perpendicular to one another so that it is possible to fill each area within one can uniformly with the filamentary strand. In so doing, the virtual pivot axis can be set in such a manner that the intake of the filamentary strand takes place at a quasi-stationary shoulder means.

For this, the embodiment of the device according to the invention is preferably used in which a deflecting roller for guiding the filamentary strand is disposed before the conveyance means. Therein the conveyance means and the deflecting roller are preferably held on a carrier plate which is connected to the end of the robot arm in such a manner that it is fixed on the end of the robot arm. The virtual axis can thus advantageously be set to be tangential to the deflecting roller at the level of the incoming filamentary strand. With this, no additional means are required in order to prevent the filamentary strand from falling off of the deflecting roller. In addition, the intake of the filamentary strand at the deflecting roller is essentially unaffected by the depositing movement of the conveyance means.

In order to obtain a uniform conveyance of the filamentary strand at higher speeds, the conveyance means is preferably formed by two driven rollers which work together to convey the strand. Drive rollers of this type customarily have on their periphery projecting guide means which penetrate into the filamentary strand to convey the filamentary strand. With this, a uniform conveyance is ensured.

In principle, however, other conveyance means, such as, for example, rollers with scrapers or conveyor belts, are also possible.

In order to make possible within a two-step process the integration between the spinning device and the filamentary line, the cans are preferably held by two halves of the can creel or by two separate can creels disposed so as to be next to one another, where from each depositing position of the robot the cans disposed next to one another in the creel halves or the cans disposed next to one another in the separate can creels are filled in alternation. It is possible to use rectangular cans, or also round cans, in order to be able to accommodate the filamentary strand.

The device according to the invention is also distinguished by the fact that independently of the arrangement of the can within the can creel it is possible to fill the cans with essentially uniform filling density. Along with this, due to the freedom of movement of the conveyance means, it is possible to produce depositing patterns within the can which lead to an improved mass distribution of the filamentary strand.

To ensure a uniform and reliable guiding of the strand, the conveyance means is positioned before each filling process into a filling position associated with one of the cans, where the movements in the filling position required for filling one of the cans are in the form of an oscillating pivoting movement and an oscillating deflecting movement about a common virtual axis.

The movement of the conveyance means processes predefined by a control algorithm of the robot, leads to a high reproducibility of the filling of the cans. The uniformity of the degree of filling of the individual cans has an effect, in particular in a further processing step, e.g. on a fiber line, in which the filamentary strand drawn out of the cans is treated further and cut to staple fibers.

The device according to the invention as well as the method according to the invention can be used independently of the process, fiber type, and can type in order to fill, uniformly with a filamentary strand, a plurality of cans next to one another within a can creel. The invention is in particular suitable in order, in a two-step staple fiber process, to lay the synthetic filaments, gathered to form a strand, continuously from a spinning device into cans of the can creel, where in parallel a portion of the cans are prepared for drawing off the strand and conveying it into a fiber line.

BRIEF DESCRIPTION OF THE DRAWINGS

The device according to the invention as well as the method according to the invention are explained in more detail in the following, with reference to the accompanying drawings, in which several embodiments are described. In the drawings.

DETAILED DESCRIPTION OF THE PREFERRED EMBODIMENTS

Figure 1:
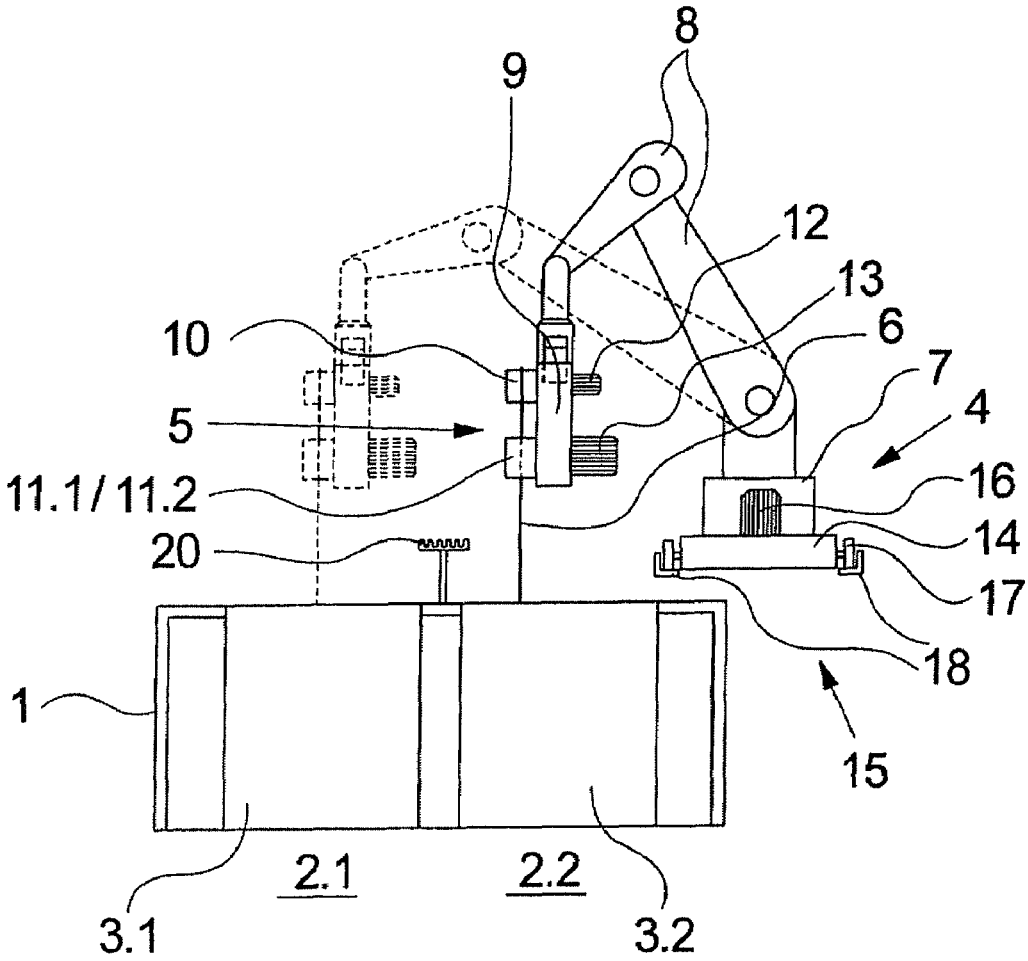
FIG. 1 is a schematic front view of a first embodiment of a device according to the invention.
Figure 2:
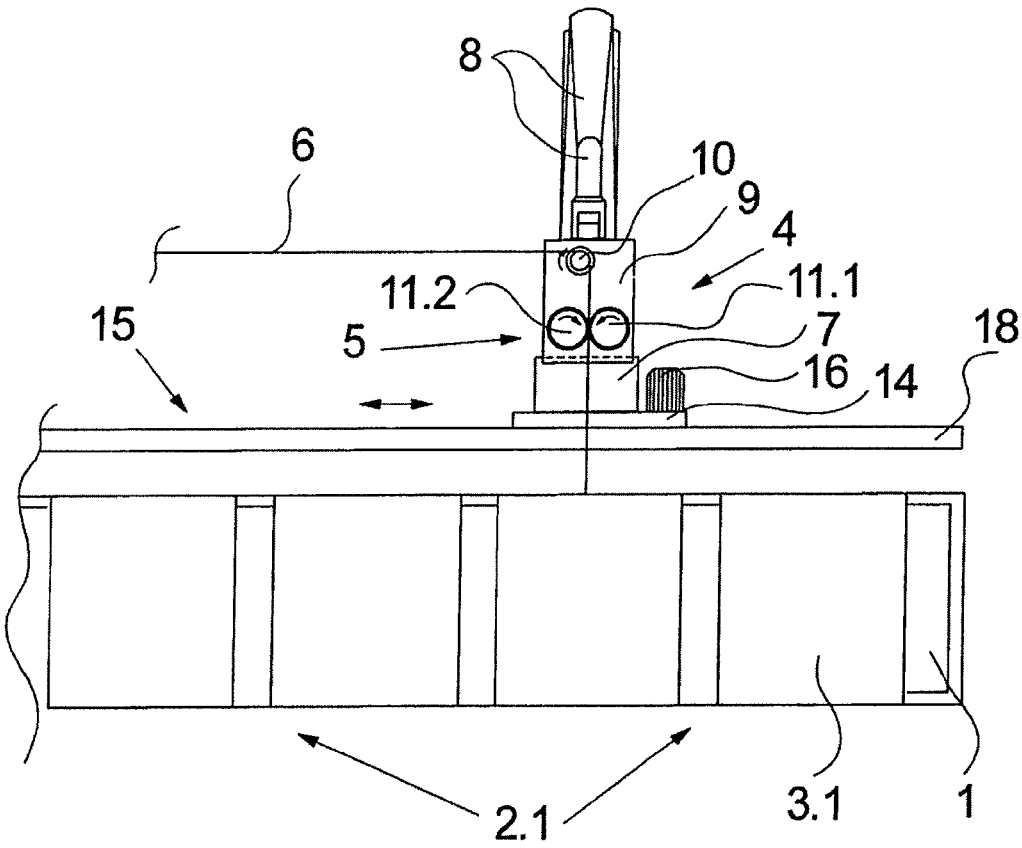
FIG. 2 is a schematic side view of the device of FIG. 1.

In FIGS. 1 and 2 a first exemplary embodiment of the device according to the invention and for carrying out the method according to the invention is represented in schematic form in several views. In so far as no express reference to one of the Figures is made, the following description applies to all the Figures.

In the first embodiment, several cans are arranged in one can creel 1 to form two can rows 2.1 and 2.2 disposed so as to be parallel to one another. The cans of the can row 2.1 are designated by the reference number 3.1 and the cans of the can row 2.2 are designated by the reference number 3.2. The cans in the can rows 2.1 and 2.2 are formed so as to be identical in their structure and size and can, for example, be formed by rectangular cans. A strand guide 20 is disposed adjacent the can creel 1, where the strand guide is located above the cans 3.1 and 3.2 between the can rows 2.1 and 2.2. The strand guide 20 serves to guide the filamentary strand when withdrawing and emptying the cans.

Above the can creel 1 a depositing device 4 is disposed. The depositing device 4 comprises a conveyance means 5 which is formed of two drive rollers 11.1 and 11.2 driven in such a manner that they work together. Before the drive rollers 11.1 and 11.2 a deflecting roller 10 is disposed through which the filamentary strand 6, which is fed continuously by a delivery mechanism not represented here, is guided. The filamentary strand 6 has been produced previously in a spinning device by gathering a plurality of extruded filament strands and fed to the depositing device 4. A spinning device of this type is, for example, known from WO 2005/078172 the disclosure of which is expressly incorporated herein by reference. In feeding the filamentary strand 6 it can in addition be advantageous if the filamentary strand drawn off from the spinning device is first guided parallel to a longitudinal side of can rows 2.1 and 2.2 in order then to be fed, depending on the position of the depositing device 4, through a deflection of about 90° to the deflecting roller 10. Thus, in particular, it is possible to draw the filamentary strand off from the spinning device uniformly.

The deflecting roller 10 of the depositing device 4 is mounted so as to project out from a carrier plate 9. On the rear side of the carrier plate 9 the deflecting roller 10 is coupled to a roller motor 12. Beneath the deflecting roller 10 the rollers 11.1 and 11.2 are mounted projecting out on the carrier plate 9. Each of the rollers 11.1 and 11.2 is driven by a roller drive 13 disposed on the rear side of the carrier plate 9.

For positioning and moving the conveyance means 5 the depositing device 4 furthermore comprises a robot 7 which is connected via a multi-axis robot arm 8 to the guide means 5. In addition to this, the carrier plate 9 is coupled at its upper area in a fixed manner to the free end of the robot arm 8. The robot 7 can be formed here by a commercially available industrial robot, e.g. of the type KR500 from the Kuka Company.

The robot 7 is held above the can creel 1 on a guide carriage 14. The guide carriage 14 is disposed on one side of the can creel 1 and can be guided back and forth in a guideway 15 running parallel to the longitudinal side of the can creel 1. In addition to this, the guide carriage 14 is held by carriage wheels 17 in two guide tracks 18 running parallel to one another. A carriage drive 16 is disposed at the carriage wheels 17 through which activation of the carriage movement is accomplished.

For filling the cans in the can creel 1 the robot 7 is first guided by the guide carriage 14 into one of several depositing positions. The depositing positions are chosen along the guideway parallel to the longitudinal side of the can creel 1 in such a manner that from each depositing position the robot 7 reaches the conveyance means 5 for filling one of the cans of the can row 2.1 and, disposed next to it, one can of the can row 2.2. In FIGS. 1 and 2 the guide carriage 14 is shown at the level of a depositing position formed by the cans 3.2. In the depositing position the conveyance means 5 is guided, by activation of the robot arm 8 by the robot 7, first into a first filling position above the can 3.2 of the can row 2.2. After reaching the filling position above the can 3.2 the robot arm 8 is moved by the robot control in such a manner that the conveyance means 5 executes several movements required for filling the can 3.2.

After reaching a certain degree of filling in the can 3.2 the robot arm 8 is activated in such a manner that the conveyance means 5 is guided into a second filling position above the can 3.1 disposed to the side of the first can. During the transition the filamentary strand 6 can, along with this, be continuously conveyed further or cut in two by a cutting device. After reaching the second filling position above the can 3.1 of the second can row 2.1 a second filling process for filling the can 3.1 begins. As soon as the can 3.1 is filled, the next filling position of the conveyance means 5 is approached by activation of the carriage drive 16 so that the robot 7 is guided by the guide carriage 14 into an adjacent depositing position. Thus, for example, the filling process can be continued at the next can of the can row 2.1.

Figure 3:
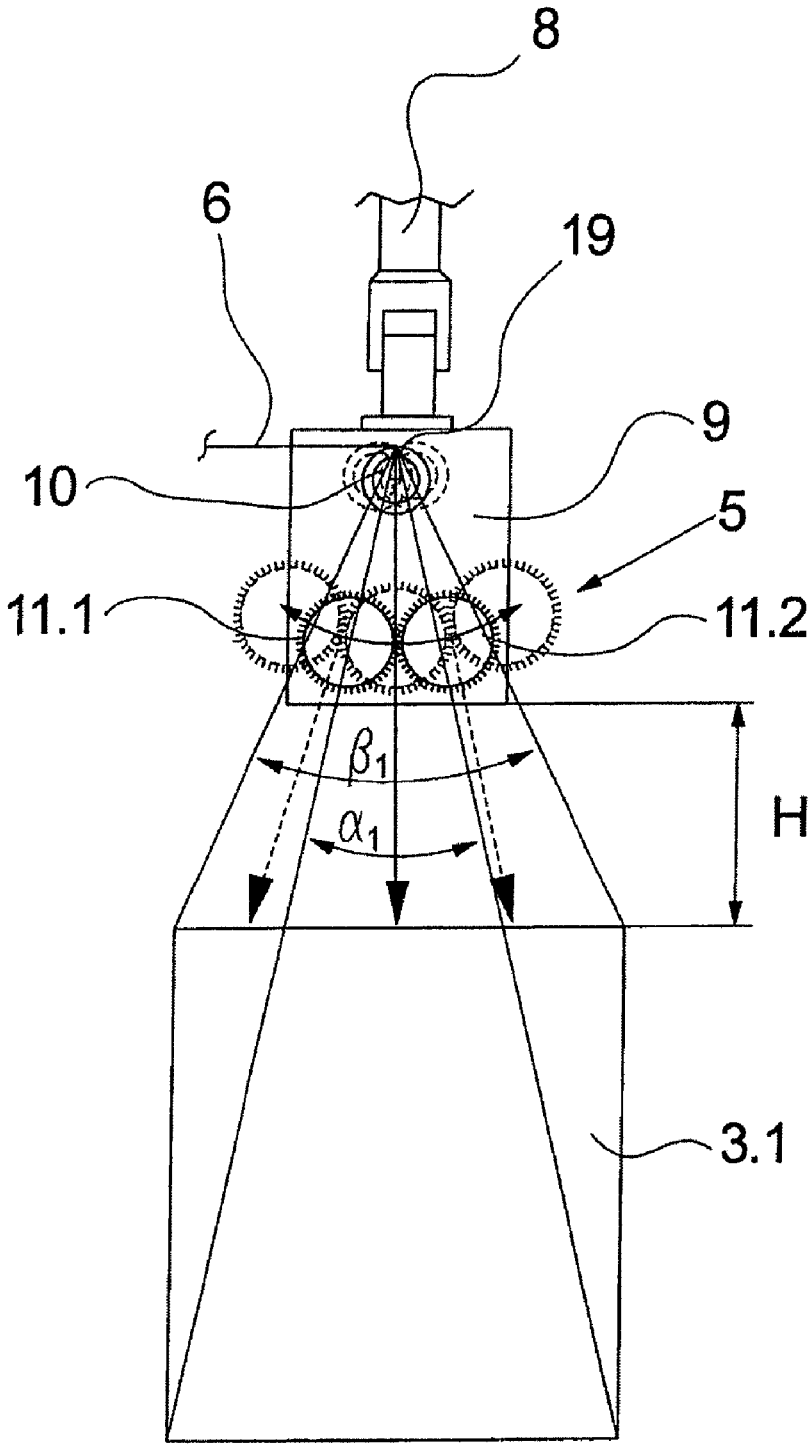
FIG. 3 is a schematic side view of the conveyance means of the device of FIGS. 1 and 2.
Figure 4:
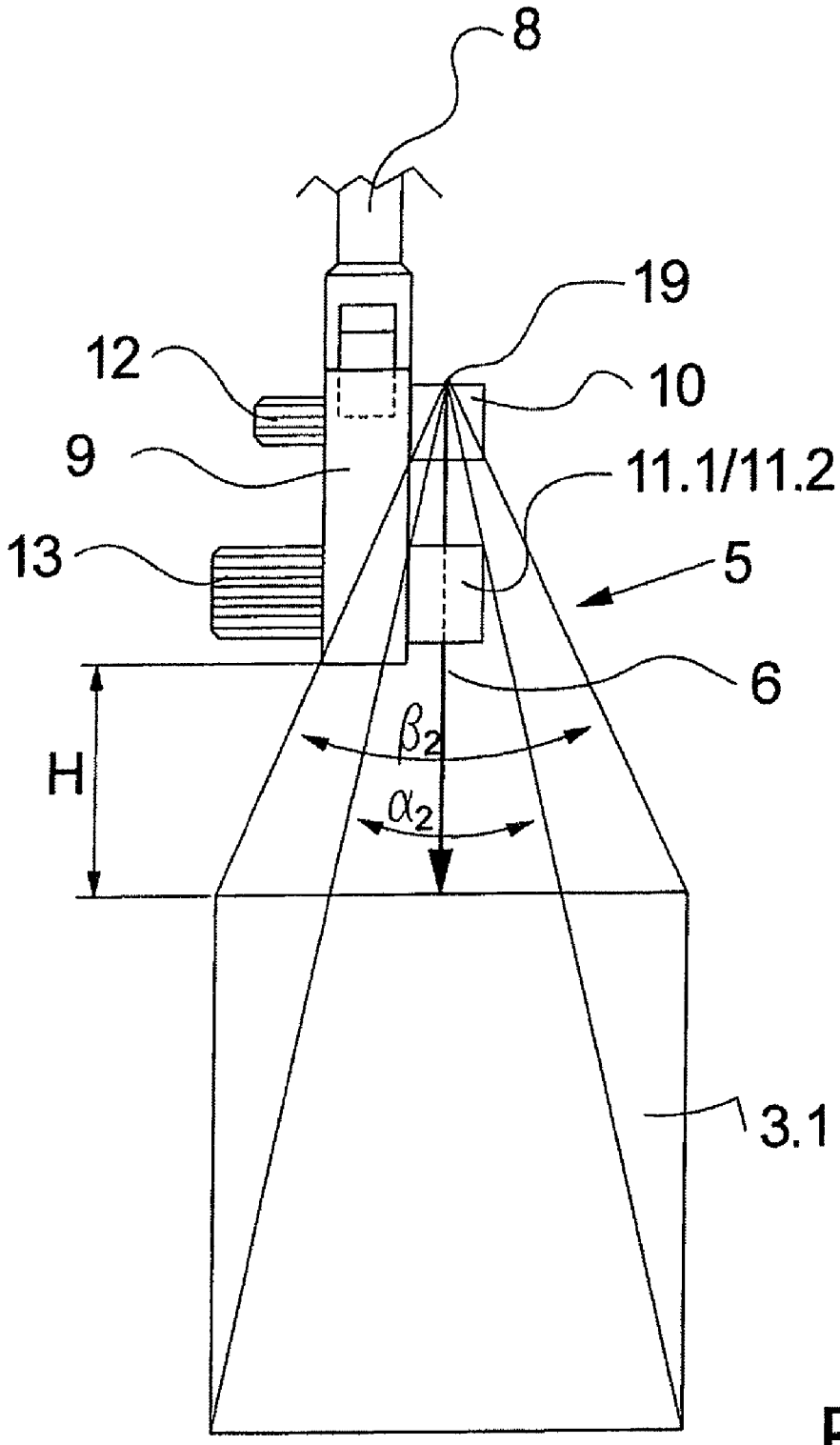
FIG. 4 is a schematic front view of the conveyance means of the device of FIGS. 1 and 2.

To explain the filling process, several views of the conveyance means 5 of the embodiment according to FIGS. 1 and 2 are shown in schematic form in FIGS. 3 and 4 during the filling of a can. FIG. 3 shows there a side view of the conveyance means 5 and FIG. 4 a front view. The following description applies, in so far as no express reference to one of the Figures is made, to both Figures.

The conveyance means 5 is formed by the drive rollers 11.1 and 11.2 held on the carrier plate 9. Before the drive rollers 11.1 and 11.2 a deflecting roller 10 is disposed which is also mounted projecting out on the carrier plate 9. Beneath the conveyance means 5 the can 3.1 is held. There the distance between the carrier plate and the upper edge of the can 3.1 is marked with the capital letter H.

In order to fill the can 3.1, which has a rectangular cross section, with filamentary strand 6, the carrier plate 9 is displaced in two superimposed movements with the deflecting roller 10 and the rollers 11.1 and 11.2 by the robot arm 8.

In FIG. 3 the amplitudes of a first pivoting movement are represented by the pivot angles $\alpha_1$ and $\beta_1$. There the filling of the can 3.1 by the filamentary strand 6 is carried out at an unvarying distance H. In this case the carrier plate 9 with the conveyance means 5 is guided at a pivot angle $\alpha_1$ at the beginning of the filling. Along with this, the movements of the robot arm 8 are controlled in such a manner that the carrier plate 9 executes a pivoting movement about a virtual pivot axis 19. The virtual pivot axis 19 runs tangentially to the peripheral surface of the deflecting roller 10, in particular in the area of the filamentary strand intake. With an increasing degree of filling of the can 3.1, the amplitude of the pivoting movement increases up to the maximum pivot angle $\beta_1$. The amplitude increasing with an increasing degree of filling is stored in the control algorithm of the robot 7 so that automated depositing of the filamentary strand is possible. Due to the position of the virtual pivot axis 19 directly in the intake area of the deflecting roller 10 the feeding of the filamentary strand 6 remains unaffected so that no feedback to the delivery mechanism disposed before is possible.

In FIG. 4 the second superimposed deflecting movement of the carrier plate 9 is represented. There the conveyance means 5 is also pivoted about the virtual pivot axis 19 which is formed to be tangent to the deflecting roller 10 at the level of the incoming filamentary strand 6. With this, a maximum running smoothness of the filamentary strand 6 during its feeding is ensured. Also here, the amplitude of the movement is changed from a first deflection angle $\alpha_2$ up to a maximum deflection angle $\beta_2$, where it is assumed that the distance H between the upper edge of the can 3.1 and the conveyance means 5 is held constant. In so doing, the deflecting movement is executed, with respect to the pivoting movement, at a speed which is slower than the pivoting speed of the pivoting movement.

In the embodiment represented in FIGS. 3 and 4 the movement of the conveyance means 5 is controlled by a six-axis robot. The feeding of the filamentary strand 6 to the conveyance means 5 could be ensured only by the represented deflecting roller 10.

Figure 5:
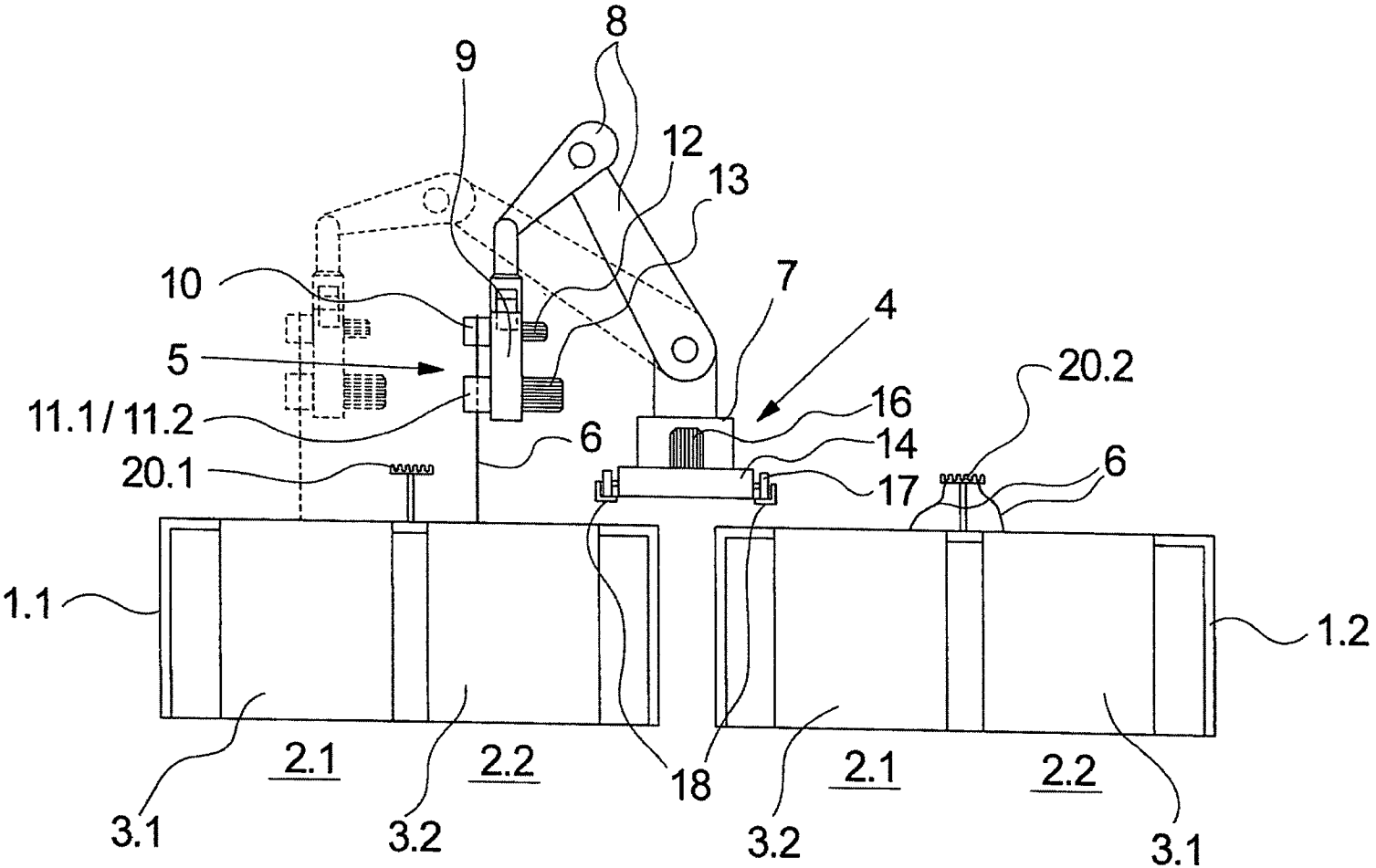
FIG. 5 is a schematic front view of an additional embodiment of the present invention.
Figure 6:
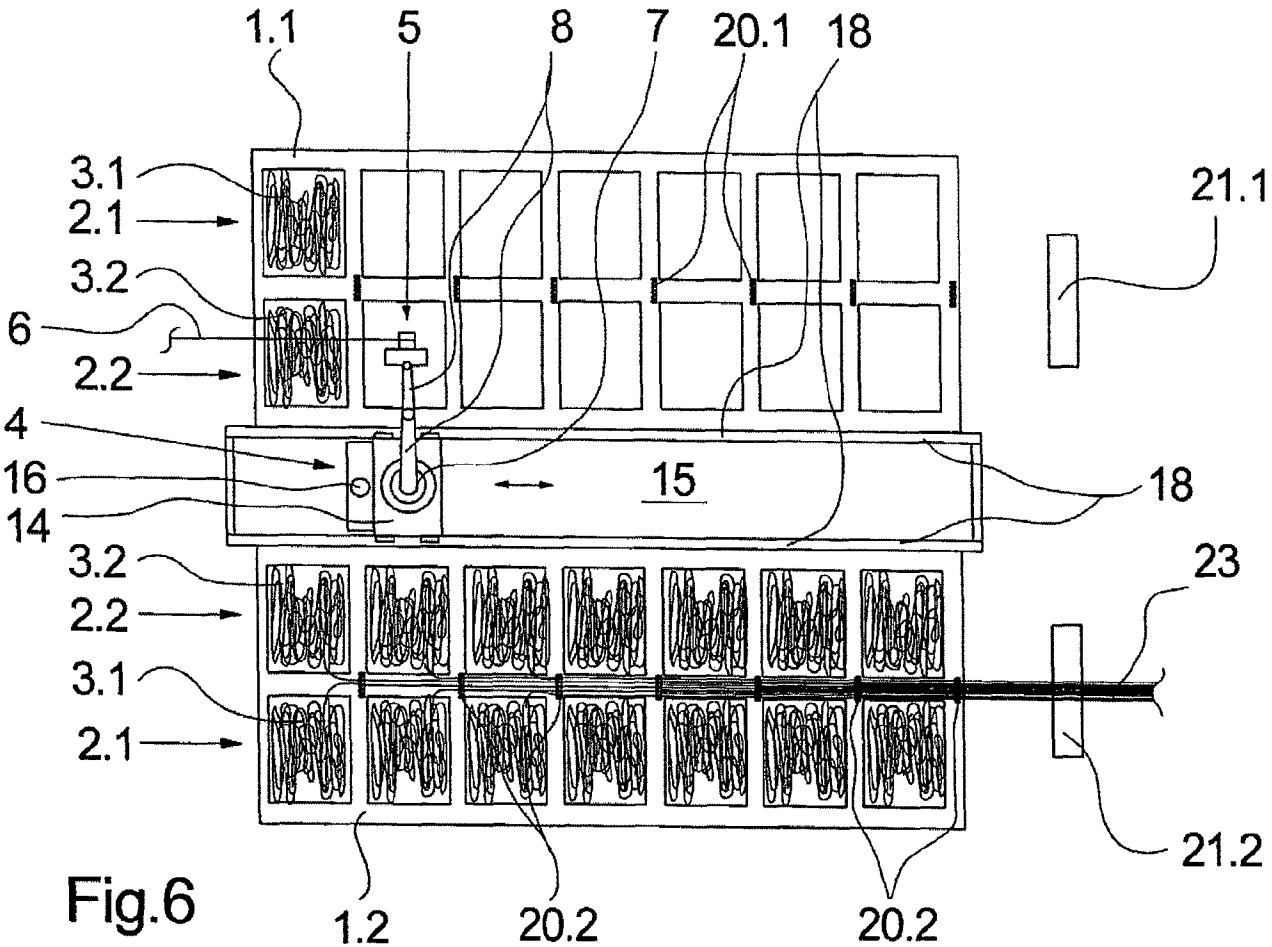
FIG. 6 is a schematic top view of the device of FIG. 5.

In FIGS. 5 and 6 an additional embodiment of the device according to the invention for carrying out the method according to the invention is shown. In FIG. 5 a front view and in FIG. 6 a top view of the embodiment is represented. The embodiment is essentially identical to the embodiment example according to FIGS. 1 and 2 so that with reference to the aforementioned description only the differences will be explained.

The depositing device 4 is disposed above the can creels 1.1 and 1.2. The can creels 1.1 and 1.2 contain a plurality of cans which are disposed in each of two can rows 2.1 and 2.2 along a longitudinal side of the can creel and next to one another. To each of the can rows 1.1 and 1.2 a strand guide 20.1 and 20.2 is assigned, each of which is held in the center with respect to the can rows 2.1 and 2.2 above the can creels 1.1 and 1.2. The strand guides 20.1 and 20.2 each act together with a guide roller 21.1 and 21.2 at one end of the can creel 1.1 and 1.2. Via the strand guide 20.1 and the guide roller 21.1 the filamentary strand can be drawn off from the cans of the can creel 1.1 and fed to a filamentary line. The strand guide 20.2 and the guide roller 21.2 serve to draw off the filamentary strand from the cans of the can creel 1.2.

The depositing device 4 comprises a robot 7 which is held on a guide carriage 14. The guide carriage 14 is guided in a guideway 15 parallel to the longitudinal sides of the can creels 1.1 and 1.2. Here the guideway 15 is disposed in a plane of symmetry between the can creels 1.1 and 1.2. In addition, the guideway 15 comprises two guide tracks 18 running in parallel which are disposed above the can creels 1.1 and 1.2 between the two can creels 1.1 and 1.2. In the guide tracks 18 the guide wheels 17 of the guide carriage 14 are guided and can be driven via a carriage drive 16. Through the guide carriage 14 the robot 7 can be guided in parallel to longitudinal sides of the can creels 1.1 and 1.2 into several depositing positions in alternation. Within each of the depositing positions the conveyance means 5 guided on the robot arm 8 of the robot 7 are positioned in alternation in filling positions above the can creels 1.1 and 1.2 in order to fill the cans of the can rows 2.1 and 2.2 one after another with the filamentary strand 6 fed continuously through the conveyance means 5. In addition, the conveyance means 5 is formed so as to be identical to the embodiment according to FIGS. 1 and 2 and comprises for guiding the filamentary strand 6 a deflecting roller 10 and two drive rollers 11.1 and 11.2 which are held together with their drives on the carrier plate 9. The carrier plate 9 is coupled, in such a manner that it is fixed, to the free end of the robot arm 8.

In the embodiment represented in FIGS. 5 and 6, the depositing device 4 is disposed at the can creel 1.1. As follows from the representation in FIG. 6, in the operational state shown the first two cans 3.1 and 3.2 of the two can rows 2.1 and 2.2 in the can creel 1.1 are already filled with the filamentary strand 6. The conveyance means 5 is located in a filling position above the can which is in the inner can row 2.2 and next to the can 3.2.

During the filling of the cans in the can creel 1.1 the cans in the can creel 1.2 are emptied by the filamentary strand 6 being drawn off via the strand guide 20.2 and the guide roller 21.2 and fed as a tow 23 to a filamentary line (not represented here). The embodiment represented in FIGS. 5 and 6 is thus suitable in particular for producing synthetic staple fibers in a two-step process. A device of this type and a method of this type follow from WO 2005/078172 A1 so that for further explanation reference is made to the cited document.

Figure 7:
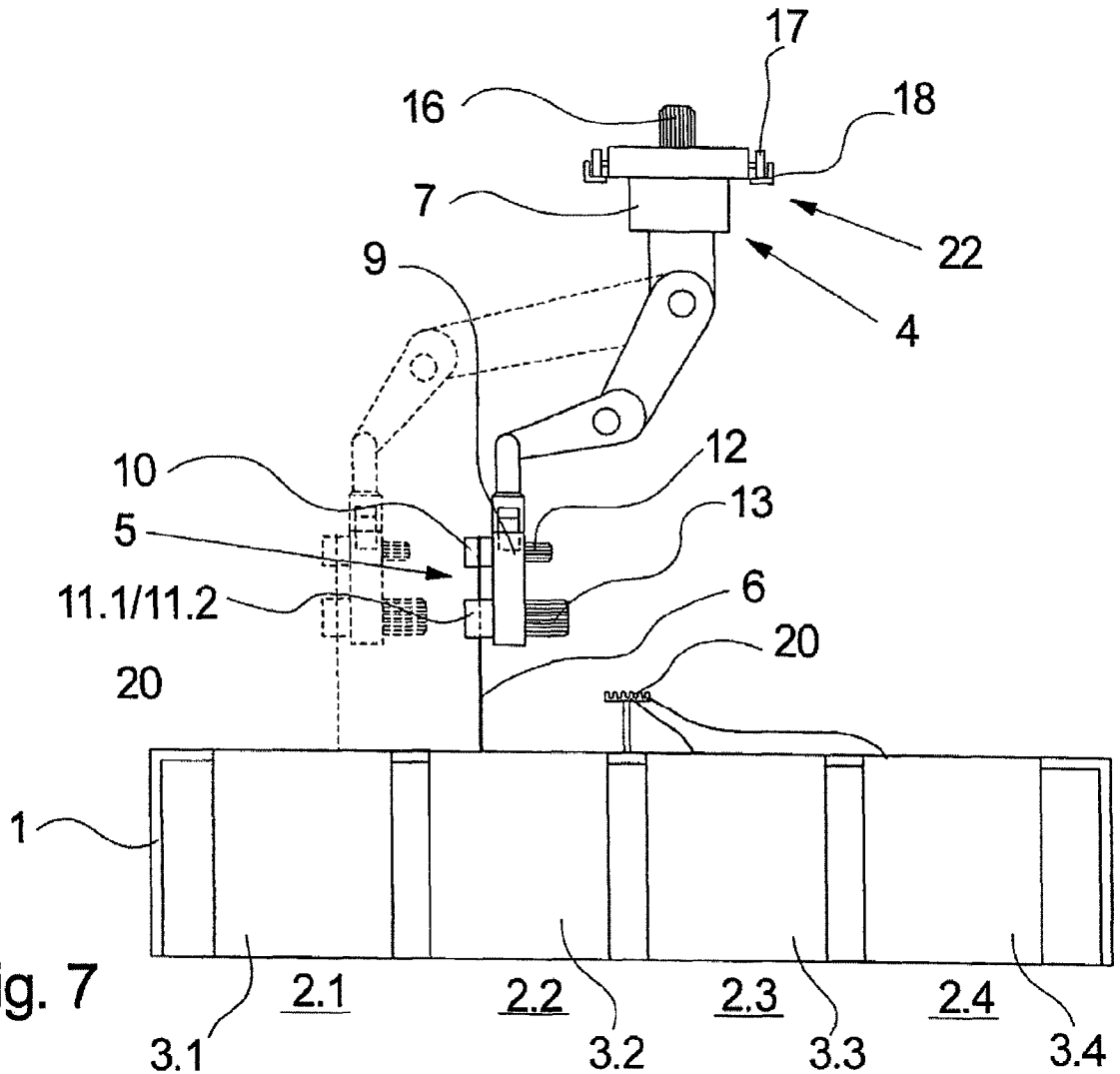
FIG. 7 is a schematic front view of a further embodiment of the device of the invention.

In FIG. 7 an additional embodiment is represented in a front view, where this embodiment is essentially identical in structure and function to the embodiment according to FIGS. 5 and 6 and to that extent would be suitable in particular for the production of synthetic staple fibers.

Thus, in the following description relating to FIG. 7 only the differences will be explained. Otherwise, reference is made to the aforementioned description.

The depositing device 4 is disposed above a can creel 1. The can creel 1 comprises a total of four can rows 2.1 to 2.4 which contain a plurality of cans. The cans of the can row 2.1 are denoted by the reference number 3.1 and the cans of the can row 2.2 are denoted by the reference number 3.2. The cans 3.1 to 3.4 are disposed in the can rows 2.1 to 2.4 so as to be parallel to a longitudinal side and next to one another in the can creel 1. Above the can creel 1 a strand guide 20 is disposed in the center with respect to the can rows 2.1 to 2.4, where the strand guide, for example, works together with a guide roller which is at the end of the can creel and not represented here. The can creel 1 is divided into two halves, where the can rows 2.1 to 2.2 form a first half and the can rows 2.3 to 2.4 form a second half of the can creel 1.

For filling the cans of the can creel 1 with a filamentary strand 6 the depositing device 4 is guided by a guide carriage 14 in a suspension track 22. The suspension track 22 is formed essentially by two guide tracks 18 in which the carriage wheels 17 of the guide carriage 14 are guided. On the guide carriage 14 the robot 7 is disposed so as to be suspended, where the robot arm 8 is turned downwards toward the can creel 1. The suspension track 22 is held in a plane of symmetry of the can creel 1 so that the robot arm 8 is guided optionally for filling the cans in the can rows 2.1 and 2.2 of the first half of the can creel 1 or for filling the cans in the can rows 2.3 and 2.4 of the second half of the can creel 1. At the free end of the robot arm 8 the conveyance means 5 is held, which continuously conveys a filamentary strand 6 fed at an essentially constant speed and stores it in the respectively associated can. The function of the depositing device 4 is identical to the embodiment example according to FIGS. 5 and 6 so that with reference to the aforementioned description no additional explanations relating thereto are given at this point.

In the operational situation represented in FIG. 7 the depositing device 4 is controlled in such a manner that the filamentary strand 6 is guided into the cans 3.1 and 3.2 of the can rows 2.1 and 2.2 one after another. In parallel to the filling process of the cans 3.1 and 3.2 in the can rows 2.1 and 2.2 the filamentary strands 6 are drawn off from the cans 3.3 and 3.4 of the can rows 2.3 and 2.4 and conveyed via the strand guide 20 to a filamentary line.

The embodiments shown in the FIGS. 1 to 7 are exemplary in their structure. As conveyance means, in principle, rollers or conveyor belts, which are combined for the execution of depositing movements with an industrial robot, are also suitable. For filling a can, commercially available industrial robots are suitable which have at least five axes of motion and an appropriate ultimate load for guiding the conveyance means. The flexibility in guiding the conveyance means ensured via the robot makes possible a flexible arrangement of the cans within a can creel. In regard to this, the can arrangements in the form of rows which are represented here are exemplary. Cans with rectangular, square, or round form can be used as well.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The term "filamentary strand" as used herein is intended to include tow, sliver, yarn, twine and other similar textile products.

That which is claimed:

1. A device for depositing an advancing filamentary strand into each of several cans of a can creel, comprising a guide carriage mounted for movement along the can creel to any one of several depositing positions, a conveyance means for positively advancing the strand into a can, and a robot comprising a multi-axis robot arm which is controllable in such a manner that a carrier plate of the conveyance means executes a pivoting movement and a second superimposed deflecting movement about a virtual pivot axis, said virtual pivot axis is formed to be tangent to a deflecting roller at the level of an incoming filamentary strand and wherein said multi-axis robot arm interconnects the conveyance means to the guide carriage so that at each depositing position of the guide carriage at least one of the cans of the can creel can be filled by the conveyance means.

2. The device of claim 1, wherein the robot and its robot arm are configured in such a manner that from at least one of the depositing positions of the guide carriage, the conveyance means can be serially guided into a plurality of filling positions so as to fill a plurality of cans one after another.

3. The device of claim 2, wherein the robot arm has at least five axes of motion through which the positioning and the movements of the conveyance means in one of the filling positions for filling the associated can can be executed and controlled.

4. The device of claim 1, wherein the guide carriage is guided between the depositing positions in at least one guideway.

5. The device of claim 4, wherein the one guideway is positioned above the can creel and the robot is suspended from the guide carriage.

6. The device of claim 4, wherein the guideway extends parallel to a longitudinal side of the can creel, wherein to one side of the guideway at least one row of cans disposed next to one another is held in the can creel and wherein the one row of cans extends generally perpendicular to the direction of the guideway.

7. The device of claim 6, wherein the guideway is disposed in a plane of symmetry of the can creel so that at both sides of the plane of symmetry at least one row of cans disposed next to one another is held in the can creel.

8. The device of claim 1, wherein the robot is programmed to control the movements of the conveyance means for depositing the tow in such a manner that the conveyance means executes an oscillating pivoting movement and an oscillating deflecting movement which are generally perpendicular to each other.

9. The device of claim 1, wherein a deflecting roller for guiding the filamentary strand is disposed before the conveyance means, wherein the conveyance means and the deflecting roller are supported on a carrier plate, and wherein the carrier plate is connected to the end of the robot arm.

10. The device of claim 1, wherein the conveyance means comprises two drive rollers which are positively driven.

11. The device of claim 1, wherein the cans are held in two halves of the can creel or by two separate can creels disposed so as to be next to one another, wherein from each depositing position of the depositing device the cans disposed next to one another in the creel halves or the cans disposed next to one another in the separate can creels are filled in alternation.

12. A method for depositing an advancing filamentary strand into each of several cans of a can creel, comprising the steps of advancing the strand by a conveyance means and sequentially positioning the conveyance means above each of the cans, moving the conveyance means in an oscillating manner about a common virtual axis which is formed to be tangent to a deflecting roller at the level of an incoming filamentary strand in each of several directions of motion for depositing the strand in each of the cans, and wherein the positioning and moving steps are executed by a multi-axis robot arm of a robot.

13. The method of claim 12, wherein for positioning the conveyance means, the free end of the robot arm is guided into a filling position above the respective can.

14. The method of claim 12, wherein for filling one of the cans with the strand, the conveyance means is moved by the robot arm with an oscillating pivoting movement and an oscillating deflecting movement, and wherein the pivoting and deflecting movements are generally perpendicular to each other.

15. The method of claim 14, wherein the pivoting and deflecting movements of the conveyance means are controlled and set by the robot independently of one another in their direction of movement, their amplitude of movement, and/or their speed.

16. The method of claim 12, wherein the moving step includes moving the conveyance means and the robot in a longitudinal direction between a plurality of depositing positions, wherein at each depositing position the conveyance means is moved transversely to the longitudinal direction between at least two filling positions, wherein at each filling position the conveyance means is moved by the robot arm with an oscillating pivoting movement and an oscillating deflecting movement, and wherein the pivoting and deflecting movements are generally perpendicular to each other.

* * * * *